US011044965B2

(12) United States Patent
Schenone et al.

(10) Patent No.: US 11,044,965 B2
(45) **Date of Patent: *Jun. 29, 2021**

(54) FOOTWEAR ANKLE COLLAR TRIM TRANSITION

(71) Applicant: NIKE, Inc., Beaverton, OR (US)

(72) Inventors: Kyle D. Schenone, Beaverton, OR (US); Ellisha K. Wright, Portland, OR (US)

(73) Assignee: NIKE, INC., Beaverton, OR (US)

( * ) Notice: Subject to any disclaimer, the term of this patent is extended or adjusted under 35 U.S.C. 154(b) by 5 days.

This patent is subject to a terminal disclaimer.

(21) Appl. No.: 16/227,607

(22) Filed: Dec. 20, 2018

(65) Prior Publication Data

US 2019/0116934 A1 Apr. 25, 2019

Related U.S. Application Data

(63) Continuation of application No. 14/885,590, filed on Oct. 16, 2015, now Pat. No. 10,182,620.

(51) Int. Cl.

| | |
|---|---|
| ***A43B 23/02*** | (2006.01) |
| ***A43B 23/07*** | (2006.01) |
| ***A43B 23/08*** | (2006.01) |

(52) U.S. Cl.

CPC ..... *A43B 23/07* (2013.01); *A43B 23/025* (2013.01); *A43B 23/026* (2013.01); *A43B 23/0235* (2013.01); *A43B 23/0255* (2013.01); *A43B 23/088* (2013.01)

(58) Field of Classification Search

CPC ... A43B 23/07; A43B 23/0235; A43B 23/025; A43B 23/0255; A43B 23/088; A43B 23/026

See application file for complete search history.

(56) References Cited

U.S. PATENT DOCUMENTS

| | | | | | |
|---|---|---|---|---|---|
| 967,064 | A * | 8/1910 | Savage | A43B 3/02 36/4 |
| 1,115,651 | A | 11/1914 | Buttles | |
| 3,378,940 | A * | 4/1968 | Potvin, Jr. | A43B 3/14 36/11 |
| 3,768,182 | A | 10/1973 | Powers | |
| 4,451,996 | A | 6/1984 | Norton et al. | |
| 4,662,088 | A | 5/1987 | Autry et al. | |
| 4,856,209 | A | 8/1989 | Kenyon | |
| 4,858,337 | A * | 8/1989 | Barma | A43B 1/10 36/4 |
| 5,189,814 | A * | 3/1993 | Barma | A43B 1/10 12/142 E |
| 5,611,156 | A | 3/1997 | Chiu | |
| 5,743,027 | A * | 4/1998 | Barma | A43B 1/10 12/142 D |
| 6,260,288 | B1 | 7/2001 | Barthelemy et al. | |

(Continued)

*Primary Examiner* — Ted Kavanaugh

(74) *Attorney, Agent, or Firm* — Shook, Hardy & Bacon L.L.P.

(57) ABSTRACT

An article of footwear having an upper with enhanced transition properties is described herein. The transition properties may be incorporated in an ankle collar trim transition region, a heel stay reinforcing structure, and/or a heel padding structure. Additionally, a method for manufacturing the article of footwear with enhanced transition properties in a heel region is provided.

17 Claims, 5 Drawing Sheets

(56) References Cited

U.S. PATENT DOCUMENTS

| | | | | |
|---|---|---|---|---|
| 7,028,418 | B1 * | 4/2006 | Huang | A43B 1/0027 12/142 RS |
| 10,182,620 | B2 * | 1/2019 | Schenone | A43B 23/07 |
| 2004/0049942 | A1 | 3/2004 | Chen | |
| 2007/0107257 | A1 * | 5/2007 | Laska | B29D 35/146 36/4 |
| 2014/0237858 | A1 | 8/2014 | Adami et al. | |
| 2014/0317962 | A1 * | 10/2014 | Smith | A43B 23/0235 36/102 |

* cited by examiner

FOOTWEAR ANKLE COLLAR TRIM TRANSITION

CROSS-REFERENCE TO RELATED APPLICATIONS

This application is a continuation application of U.S. Nonprovisional application Ser. No. 14/885,590, filed on Oct. 16, 2015, entitled "Footwear Ankle Collar Trim Transition," which is hereby expressly incorporated by reference in its entirety.

BACKGROUND

Traditionally, articles of footwear included ankle collars that are bulky and generally inflexible. Ankle collars may be particularly inflexible when an article of footwear is new. Consequently, a traditional ankle collar is generally broken-in over time to gain flexibility.

TECHNICAL FIELD

The present disclosure relates to an upper of a shoe. More particularly, the present disclosure relates to an upper having an ankle collar trim transition.

BRIEF DESCRIPTION OF THE DRAWINGS

Illustrative embodiments of the present invention are described in detail below with reference to the attached drawing figures, which are incorporated by reference herein and wherein.

DETAILED DESCRIPTION

Figure 1:
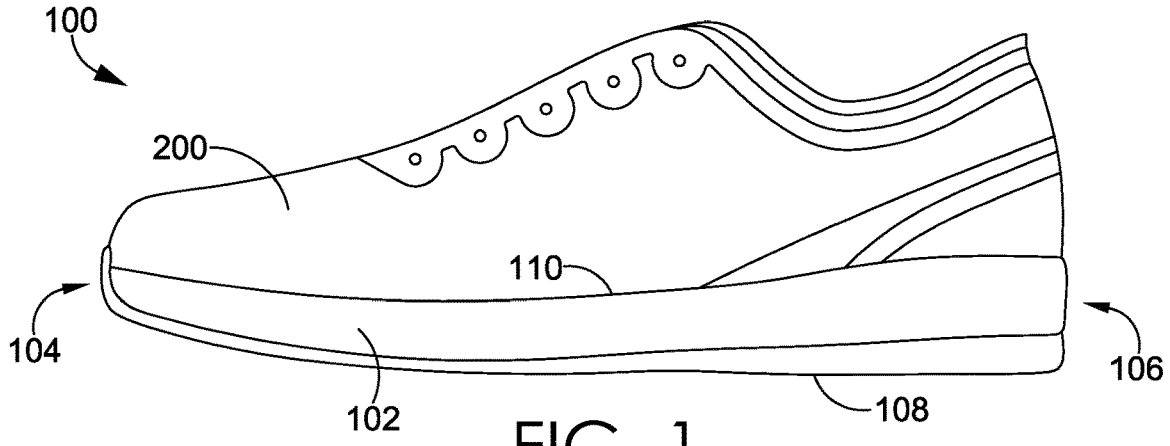
FIG. 1 depicts a lateral-side view of an article of footwear, in accordance with aspects hereof.

The subject matter of the present invention is described with specificity herein to meet statutory requirements. However, the description itself is not intended to limit the scope of this patent. Rather, the inventors have contemplated that the claimed subject matter might also be embodied in other ways, to include different features or combinations of features similar to the ones described in this document, in conjunction with other present or future technologies. Although the terms "step" and/or "block" might be used herein to connote different elements of methods employed, the terms should not be interpreted as implying any particular order among or between various steps herein disclosed unless and except when the order of individual steps is explicitly stated.

At a high level, aspects described herein relate an article of footwear with regions that provide for an improved transition between materials of an upper of the article of footwear. For example, in one aspect, the present invention provides for an ankle collar trim transition that provides a transition from the resilient materials of the main portion of the upper to more flexible materials at a top portion of the ankle collar. Accordingly, in exemplary aspects, the ankle collar trim transition has an inner material, an ankle collar reinforcing material, and an upper first material. The inner material may extend to a top edge of the ankle collar. Additionally, the reinforcing material may overlap a top edge of the upper first material and retain the top edge of the upper first material in intimate contact against an outer surface of the inner material. In this way, the ankle collar may transition from a region having multiple materials to a region having only the flexible inner material, in an exemplary aspect. As a result, the present invention provides an ankle collar that is robust and comfortable. Additionally, the flexible inner material provides a comfortable surface without requiring a lengthy break-in period.

Other aspects herein relate to transition regions for a heel stay, which may be at the exterior of the upper, and the heel padding, which may be at the interior of the upper. Further, aspects herein relate to a method for manufacturing the article of footwear having the features described according to aspects herein.

Aspects herein relate to an upper of an article of footwear with various transition, reinforcing, and padding regions. In exemplary aspects, the upper may have an ankle collar trim transition with an inner material that extends from proximate a bottom edge of a heel region to a top edge of the heel region. The upper may also have an upper first material and an ankle collar reinforcing material. In some aspects, the inner material has a top edge that is superior to both of a top edge of the upper first material and a top edge of the ankle collar reinforcing material.

In other aspects, the upper may have a heel stay reinforcing structure. The heel stay reinforcing structure may have multiple reinforcing regions. The heel stay reinforcing regions may comprise one or more heel stay reinforcing materials. The heel stay reinforcing structure is constructed, in an exemplary aspect, such that the number of reinforcing materials and the thickness of the heel stay reinforcing structure increases from a top edge of the heel stay reinforcing structure to a bottom edge of the heel stay reinforcing structure.

In another aspect, the upper may have one or more heel padding regions. The one or more heel padding regions include one or more heel pads disposed beneath the inner material of the heel region. As such, enhanced padding may be provided to a wearer of the article of footwear.

Additional aspects herein relate to a method for manufacturing an article of footwear having an ankle collar trim transition. The method may include forming a substantially planar upper from an upper first material; coupling an inner material to a portion of the upper corresponding to an interior heel surface of the article of footwear, the inner material having a top edge extending beyond a top edge of the upper first material at an ankle collar. The method for manufacturing the article of footwear may further include coupling an ankle collar reinforcing material to an exterior heel surface of the article of footwear at the ankle collar, wherein the ankle collar reinforcing material is disposed below the top edge of the inner material and below the top edge of the upper first material.

FIG. 1 depicts a lateral-side view of an article of footwear 100 having an ankle collar, in accordance with aspects hereof. The construction of the article of footwear may have the basic construction of an athletic-type shoe. However, it is contemplated that concepts provided herein are applicable to other types of footwear, such as loafers, dress shoes, boots, and the like. Because much of the construction of the article of footwear 100 is the same as that of a conventional athletic shoe, the conventional features of the constructions will be described only generally herein. While the terms "medial" and "lateral" will be used herein for purposes of convenience, it is intended and understood that each term could be substituted for the other term. This substitution is, in part, to allow for a right shoe construction and a left shoe construction.

Additionally, relative location terminology will be utilized herein. For example, the term "proximate" is intended to mean on, about, near, by, next to, at, and the like. Therefore, when a feature is proximate another feature, it is close in proximity but not necessarily exactly at the described location, in some aspects. Terminology relating to relative positions of various features of the article of footwear is also used herein. For example, the terms "superior," "superior to," and "above" are intended to mean that features herein are nearer a top edge of the article of footwear than a sole of the article of footwear, as compared to other features. Additionally, the term "top" is intended to indicate a portion of a feature that is nearer the top edge of the article of footwear than the sole of the article of footwear. Accordingly, the term "bottom" refers to a portion of a feature that is nearer the sole of the article of footwear than the top edge of the article of footwear. Further, directional terminology is used herein. For example, the term "vertically" is intended to mean that a feature extends in a direction extending from the sole of the article of footwear toward the top edge of the article of footwear, or vice versa. Additionally, the term "horizontally" is intended to mean that a feature extends in a direction extending from a heel end of the article of footwear toward a toe end of the article of footwear, or vice versa. Accordingly, the term "diagonally" is intended to indicate that a feature extends both vertically and horizontally. Further, the term "edge," as used herein refers to a terminating edge of a material and not a portion of the material, such as an apex.

The article of footwear 100 has a sole 102 that is constructed of resilient materials that are typically employed in the construction of soles of athletic shoes. The sole 102 can be constructed with an outsole, a midsole, and/or an insert, as is conventional. The size of the article of footwear 100 has a length that extends from a sole toe end 104 to a sole heel end 106 of the sole 102. The sole 102 has a bottom surface 108 that functions as the traction surface of the article of footwear, and an opposite top surface 110. The sole 102 may be coupled to an upper 200.

Figure 2:
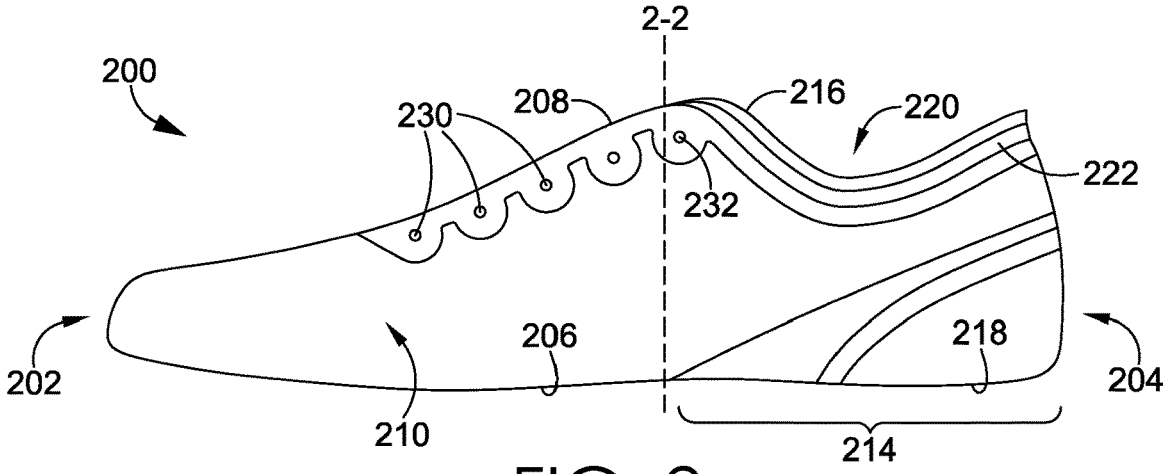
FIG. 2 depicts a lateral-side view of an upper of the article of footwear according to FIG. 1, in accordance with aspects hereof.

FIG. 2 depicts a lateral-side view of upper 200 of the article of footwear 100 according to FIG. 1, in accordance with aspects hereof. The upper 200 has a toe end 202 (e.g., forward end) and an opposite heel end 204 (e.g., rear end). The upper 200 additionally has an upper bottom edge 206 and an opposite upper top edge 208. The upper top edge 208 may form a portion of a throat opening and an ankle opening of the upper 200, in an exemplary aspect. Further, the upper 200 has a lateral side 210 and an opposite medial side (depicted in FIG. 3 as medial side 212). The upper 200 may further have a plurality of lacing mechanisms 230 (e.g., apertures) proximate the upper top edge 208 on both the lateral side 210 and the medial side (depicted in FIG. 3 as medial side 212). The plurality of lacing mechanisms 230 may additionally include a first lateral side lacing mechanism 232 and a first medial side lacing mechanism (not shown).

The lacing mechanisms may be an aperture through which a string or lace is intended to pass. Additional lacing mechanisms are also contemplated such as hooks, loops, integrated fibers/strings, and the like. For example, the lacing mechanisms 230 may be a lacing opening that is typically occupied by a portion of a fastener, such as lacing that closes the article of footwear upper over a midfoot opening of the article of footwear. However, in an exemplary embodiment, the lacing mechanisms 230 are an eyelet or grommet style aperture. The lacing mechanisms 230, in a non-limiting example, are arranged in lines along the lateral side 210 and the medial side.

The upper 200 may be constructed with a heel region 214 that extends around the heel end 204. In some aspects, the heel region 214 also extends upwardly from the upper bottom edge 206 to the upper top edge 208. Further, the heel region 214 extends horizontally from the heel end 204 toward the toe end 202 on the lateral side 210 and the medial side. In some aspects, a portion of the heel region 214 extends to a portion of the upper 200 proximate the first lateral side lacing mechanism 232 and the first medial side lacing mechanism, as shown by line 2-2. The heel region 214 has a heel region top edge 216 at a portion of the upper top edge 208 and a heel region bottom edge 218 at a portion of the upper bottom edge 206. The heel region top edge 216 defines, in part, an ankle opening 220. The ankle opening 220 provides access to an article of footwear interior. A strobel (depicted in FIG. 5 as 207) may be affixed along or proximate the length of the upper bottom edge 206 and may be coupled to the sole 102. The upper 200 may additionally have an ankle collar 222 proximate the heel region top edge 216. The ankle collar 222 may be substantially aligned to the heel region top edge 216 and may extend around the heel end 204 to a portion of the upper 200 proximate line 2-2. In some aspects, the ankle collar 222 includes a reinforcing material (as depicted hereinafter in FIG. 5 as 506) that extends around the heel end 204 from the medial side to the lateral side of the upper 200. The reinforcing material may, for example, comprise an elongate band, as will be discussed in further detail hereinafter.

It is contemplated that the upper 200 may be formed as an integrally manufactured article. Stated differently, the upper 200 may be formed in a unitary fashion from a common machine that utilizes varying techniques to impart structural and dimensional characteristics. Advantages of a unitarily formed upper over traditional shoe manufacturing may include reduced labor, reduced time, and greater quality control, in an exemplary aspect. The upper 200 may be constructed having different characteristics at various portions/regions of the upper 200. For example, it is contemplated that portions of upper 200 may be formed as multilayer density woven and/or knit regions. Additionally, the upper 200 may have multiple layers for reinforcement against ripping, tearing, unraveling, and other potentially destructive characteristics. In an exemplary aspect, the upper 200 may be formed with a high density weaving technique that may incorporate varied materials (e.g., low stretch synthetic fibers). Additionally, it is contemplated that the upper 200 may be formed with a multi-layer weaving technique.

In other aspects, the upper 200 may be substantially planar and may be manufactured in a sheet-like manner having varied materials (e.g., organic, synthetic), varied manufacturing techniques (e.g., differing weaving/knitting techniques), varied physical properties (e.g., modulus of elasticity, impact attenuation), and/or varied geometric properties (e.g., shape, dimension, thickness). It is further contemplated that the upper 200 may be formed in a multiple-unit operation that results in a number of similar or different uppers to be formed during a common manufacturing operation. The upper 200 may then be removed from the multi-unit collection by cutting, trimming, sheering, etching, burning, melting, and other known techniques. Because the upper 200 may have portions in which mechanical fastening (e.g., sewing, bonding, tacking, and the like) may be implemented to transform a substantially planar upper to a three-dimensional upper, properties that provide enhanced resistance to deformation may be implemented. In additional aspects, the upper 200 may also be formed with traditional cut and sew techniques and any variation thereof are contemplated as being within the scope herein.

Figure 3:
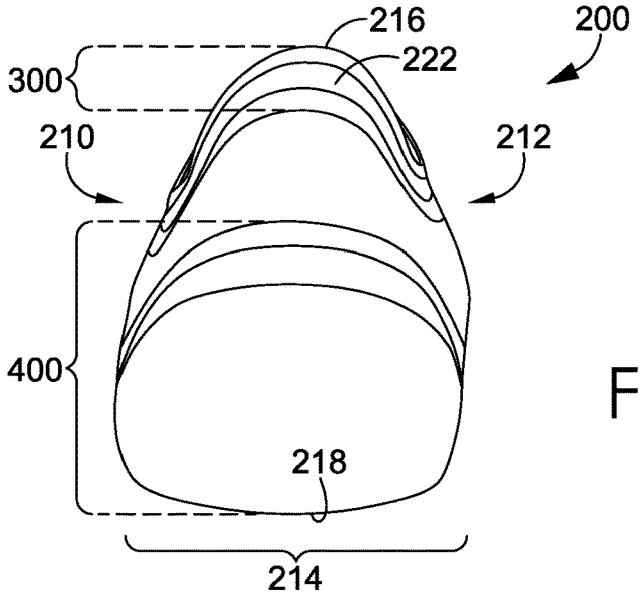
FIG. 3 depicts a heel-end view of the upper according to FIG. 2, in accordance with aspects hereof.

FIG. 3 depicts a heel-end view of the upper 200 according to FIG. 2, in accordance with aspects hereof. As seen in FIG. 3, the heel region 214 extends horizontally from the lateral side 210 to the medial side 212 of the upper 200. Additionally, the heel region 214 extends vertically from the heel region bottom edge 218 to the heel region top edge 216. FIG. 3 further depicts an ankle collar trim transition 300 at ankle collar 222, which will be described in more detail below. The upper 200 may additionally have a heel stay reinforcing structure 400, which will also be described in more detail below.

Figure 4:
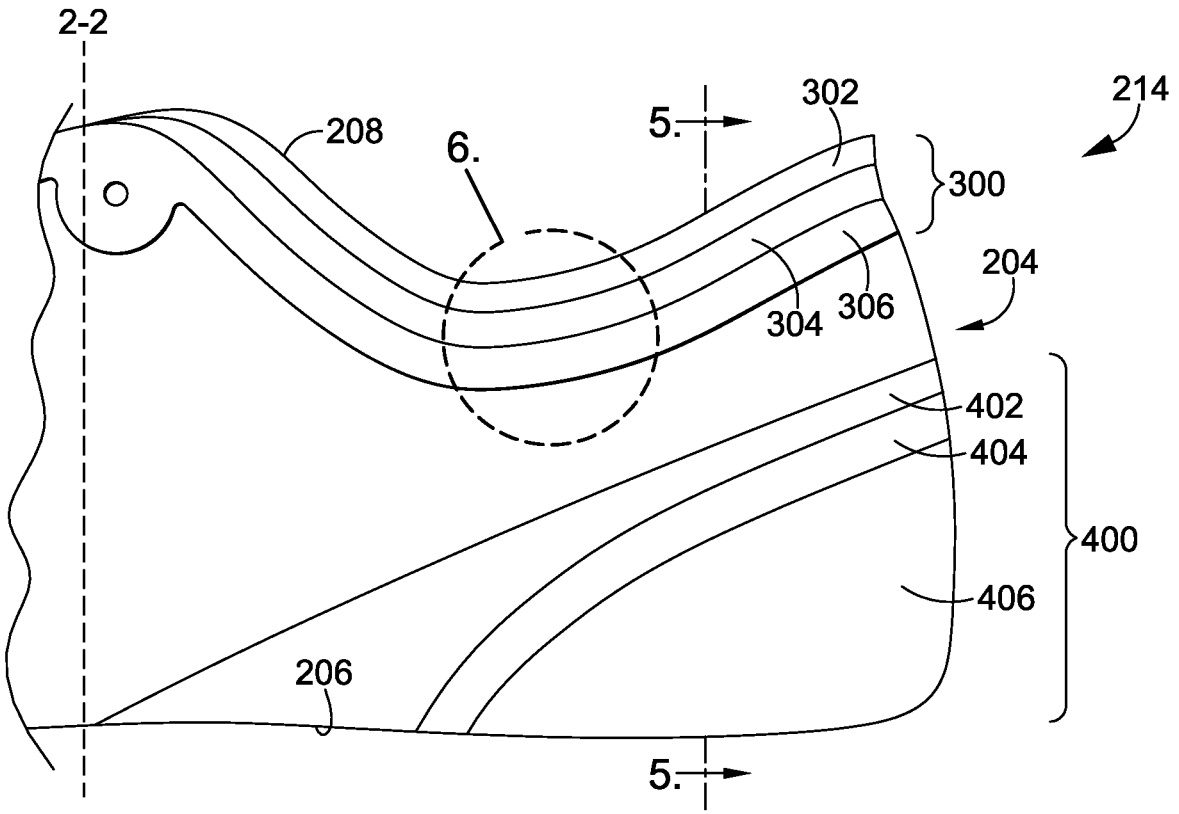
FIG. 4 depicts a partial lateral-side view of the heel region of the upper according to FIG. 2, in accordance with aspects hereof.

FIG. 4 depicts a partial lateral-side view of the heel region 214 of the upper 200 according to FIG. 2, in accordance with aspects hereof. In some aspects, the ankle collar trim transition 300 includes a first ankle collar trim transition region 302, a second ankle collar trim transition region 304, and a third ankle collar trim transition region 306. FIG. 4 additionally depicts the heel stay reinforcing structure 400. The heel stay reinforcing structure 400 may include a first heel stay reinforcing region 402, a second heel stay reinforcing region 404, and a third heel stay reinforcing region 406. In some embodiments, the heel stay reinforcing structure 400 extends horizontally around the heel end 204 toward line 2-2 and extends vertically from the upper bottom edge 206 toward the upper top edge 208. In some aspects, the heel stay reinforcing structure 400 extends diagonally from a portion of the heel end 204 toward line 2-2 and the heel region top edge 216.

Figure 5:
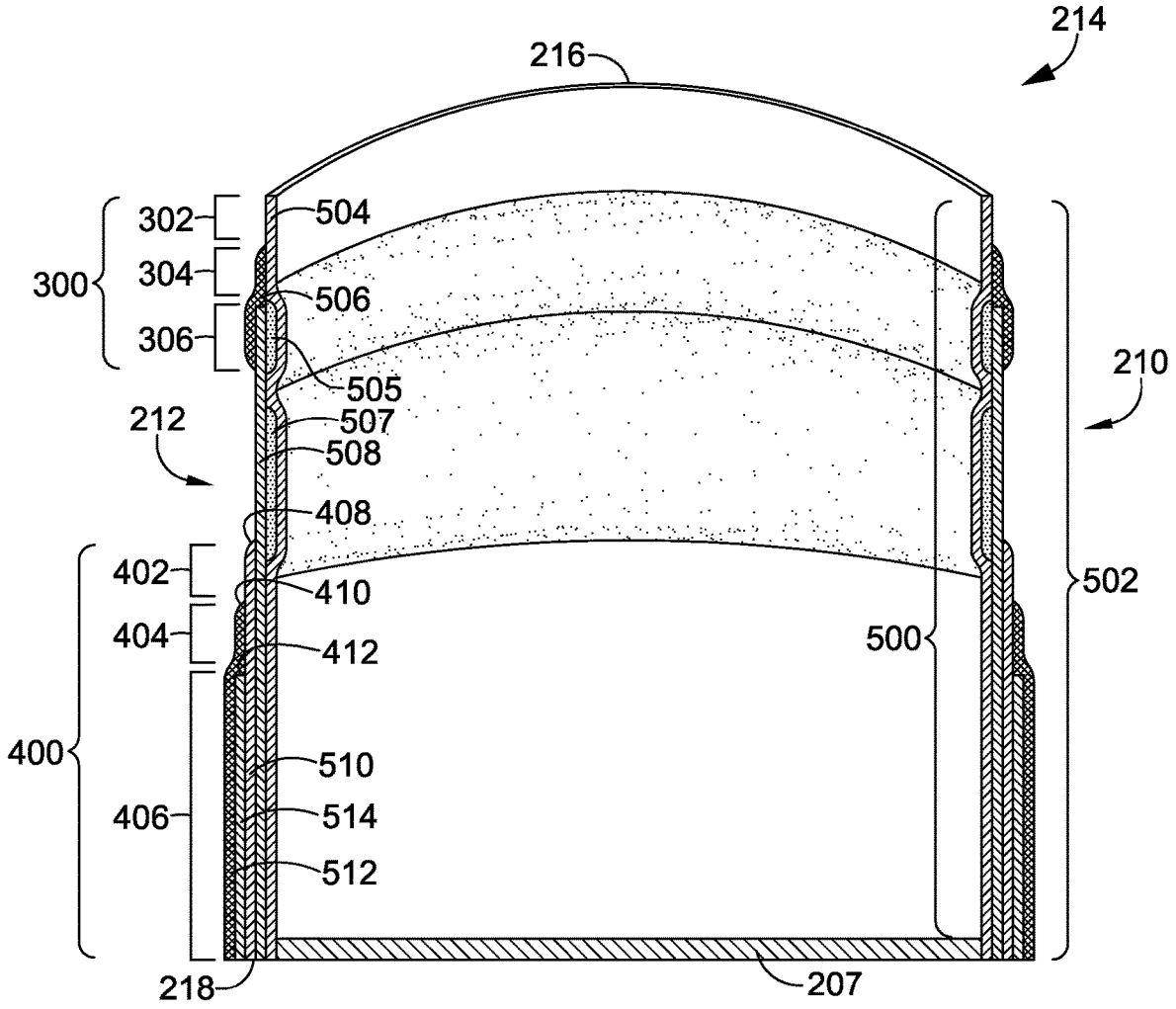
FIG. 5 depicts a cross-sectional view of the heel region of the upper along line 5-5 of FIG. 4, in accordance with aspects hereof.

FIG. 5 depicts a cross-sectional view along line 5-5 of the heel region 214 of the upper 200 according to FIG. 4, in accordance with aspects hereof. Heel region 214 has an interior surface 500 including an inner material 504, and an opposite exterior surface 502. Interior surface 500 corresponds to an inside of the article of footwear 100 and the exterior surface 502 corresponds to an outside of the article of footwear 100. As will be appreciated, the inside of the article of footwear 100 refers to a portion of the article of footwear 100 that is proximate the foot of a wearer when the article of footwear 100 is in an as-worn position. Accordingly, the outside of the article of footwear 100 is opposite the inside of the article of footwear 100. The heel region 214, in an example, may additionally have the inner material 504 that extends vertically from the heel region bottom edge 218 to the heel region top edge 216 and that extends horizontally from the upper lateral side 210 to the upper medial side 212. However, it is alternatively contemplated that the inner material 504 extends from a location between the heel region bottom edge 218 and the heel region top edge 216 towards or to the heel region top edge 216. In some aspects, the inner material 504 comprises the entirety of the interior surface 500 of the heel region 214, but is also contemplated that the inner material 504 forms less than the entirety of the interior surface 500 of the heel region 214. In additional aspects, the heel region 214 has an upper first material 508 adjacent to the inner material 504. A strobel 207 (or an insole or a midsole) may be affixed to the heel region 214 proximate the heel region bottom edge 218, such that the strobel 207 extends horizontally from the upper lateral side 210 to the upper medial side 212.

In additional aspects, the heel region 214 also has an ankle collar reinforcing material 506 that extends horizontally around the heel region 214 and, in an exemplary aspect, substantially parallel to the heel region top edge 216 at the exterior surface 502 of the heel region 214. The ankle collar reinforcing material 506 may extend around the heel end 204 (shown in FIG. 2) from the medial side 212 to the lateral side 210 of the upper 200. The ankle collar reinforcing material 506 may, for example, comprise an elongate band of a thermoplastic material that is thermally bonded with each of the inner material 504 and at least the upper first material 508. In a non-limiting example, the ankle collar reinforcing material 506 and the other reinforcing materials described herein may be comprised of a thermoplastic polyurethane ("TPU"); an ethylene vinyl acetate ("EVA"); a polyolefin; synthetic or natural rubber (e.g., thermoset rubber having a sulfur or peroxide cured crosslink); silicone; cross-linked polyolefin foam (e.g., EVA, butane-based block copolymers, octane-based copolymers, mixtures thereof); thermoset polyurethane foam (e.g., polyester, polyether, polycaprolactone); or thermoset polyurethane elastomers (e.g., polyester, polyether, polycaprolactone).

The inner material 504 may extend to and form the heel region top edge 216. The ankle collar reinforcing material 506 may be bonded with exterior surfaces of each of the inner material 504 and the upper first material 508. Additionally, the ankle collar reinforcing material 506 may overlap a top edge of the upper first material 508 and retain the top edge of the upper first material 508 in intimate contact against an outer surface (shown as outer surface 526 in FIG. 7) of the inner material 504. The ankle collar reinforcing material 506 may provide structural support for an ankle collar and may be less malleable than the inner material 504. Further, the ankle collar reinforcing material 506 may not extend all the way to the heel region top edge 216 and may extend over the top edge of the upper first material 508. As a result, the ankle collar reinforcing material 506 may facilitate a transition between the more rigid materials of the upper 200, for example the upper first material 508, and the relatively less rigid inner material 504. Accordingly, the heel region top edge 216 may comprise only the inner material 504. As such, the inner material 504 may provide a soft and flexible engagement with an ankle of a wearer proximate the heel region top edge 216, while the upper first material 508 and the ankle collar reinforcing material 506 may provide structural support below the heel region top edge 216.

As mentioned hereinabove, the ankle collar trim transition 300 may include the first ankle collar trim transition region 302, the second ankle collar trim transition region 304, and the third ankle collar trim transition region 306. In aspects herein, the first ankle collar trim transition region 302 comprises the inner material 504, and does not comprise the upper first material 508 nor the ankle collar reinforcing material 506. As a result, in some aspects, the first ankle collar trim transition region 302 is substantially only formed of the inner material 504, thereby providing the soft and flexible engagement with the ankle of the wearer. Additionally, in aspects herein, the second ankle collar trim transition region 304 substantially formed from the inner material 504 and the ankle collar reinforcing material 506, and does not comprise the upper first material 508. In aspects herein, the third ankle collar trim transition region 306 comprises the inner material 504, the ankle collar reinforcing material 506, and the upper first material 508. Consequently, in some aspects, the ankle collar trim transition 300 increases the number of materials used, and thus the reinforcing properties, as the ankle collar trim transition 300 extends from the heel region top edge 216 toward the heel region bottom edge 218. Stated differently, the ankle collar trim transition is formed from an increasing number of layers of material extending in a downward direction towards heel region bottom edge 218.

In aspects, the heel region 214 additionally includes a first heel stay reinforcing material 510 adjacent to the upper first material 508, a second heel stay reinforcing material 512, and a third heel stay reinforcing material 514. As mentioned hereinabove, the heel stay reinforcing structure 400 may include one or more reinforcing regions to provide enhanced stability and durability to the heel region 214. As can be appreciated, the types and number of reinforcing materials used at the heel stay reinforcing structure 400 may vary depending on the desired properties. The number of materials and the thickness of the heel stay reinforcing structure 400 gradually decrease as the heel stay reinforcing structure extends upwardly from the heel region bottom edge 218 toward the heel region top edge 216 at the heel end 204. As a result, the heel stay reinforcing structure 400 provides enhanced strength, in an exemplary aspect, at a bottom portion and gradually decreases as extending upwardly.

In one aspect, the heel stay reinforcing structure 400 includes the first heel stay reinforcing region 402, the second heel stay reinforcing region 404, and the third heel stay reinforcing region 406. In aspects herein, the first heel stay reinforcing region 402 is formed from the inner material 504, the upper first material 508, and the first heel stay reinforcing material 510, and does not comprise the second heel stay reinforcing material 512 nor the third heel stay reinforcing material 514. In additional aspects, the second heel stay reinforcing region 404 is formed from the inner material 504, the upper first material 508, the first heel stay reinforcing material 510, and the second heel stay reinforcing material 512, and does not comprise the third heel stay reinforcing material 514. In additional aspects, the third heel stay reinforcing region 406 comprises the inner material 504, the upper first material 508, the first heel stay reinforcing material 510, the second heel stay reinforcing material 512, and the third heel stay reinforcing material 514. Accordingly, in aspects, a top edge of the first heel stay reinforcing region 408 is superior to a top edge of the second heel stay reinforcing region 410, and the top edge of the second heel stay reinforcing region 410 is superior to a top edge of the third heel stay reinforcing region 412.

Additionally, the heel region 214 may include a first heel padding material 507 and a second heel padding material 505. The first heel padding material 507 and the second heel padding material 505 may be employed to provide additional padding proximate the heel end 204 of the heel region 214. The first heel padding material 507 and the second heel padding material 505 may be disposed between and coupled to the inner material 504 and the upper first material 508. The first heel padding material 507 and the second heel padding material 505 may be incorporated in, for example, a heel padding structure (depicted in FIG. 8 as 600).

Figure 6:
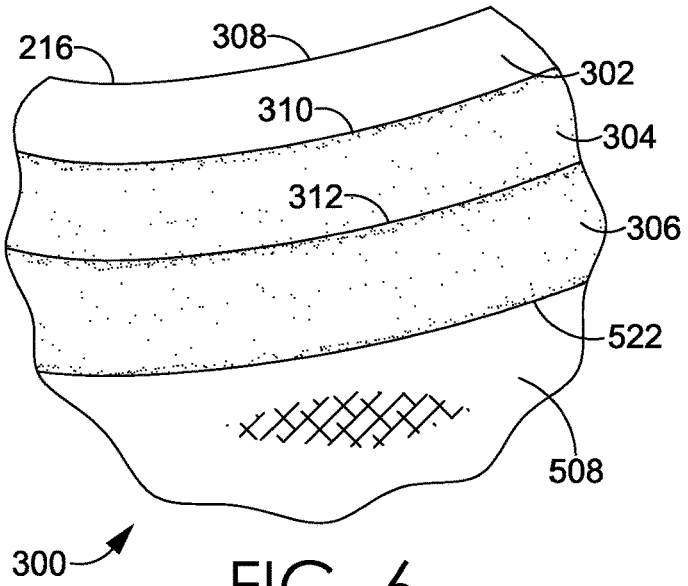
FIG. 6 depicts a close-up view of an ankle collar trim transition of the upper according to FIG. 4, in accordance with aspects hereof.

FIG. 6 depicts a close-up view of an ankle collar trim transition 300 of the upper 200 according to FIG. 4, in accordance with aspects hereof. In the aspect depicted in FIG. 6, the ankle collar trim transition 300 is disposed between the heel region top edge 216 and an ankle collar reinforcing material bottom edge 522. Additionally, a top edge 308 of the first ankle collar trim transition region 302 is superior to a top edge 310 (which may be a top edge of the ankle collar reinforcing material 506 as depicted in FIG. 5, for example) of the second ankle collar trim transition region 304, and is superior to a top edge 312 of the third ankle collar trim transition region 306. Further, the top edge 310 of the second ankle collar trim transition region 304 is superior to the top edge 312 of the third ankle collar trim transition region 306.

As a result, the ankle collar trim transition 300 has a thickness that gradually decreases as the ankle collar trim transition 300 extends upward. Consequently, the ankle collar trim transition 300 provides enhanced flexibility at the first ankle collar trim transition region 302 relative to the second ankle collar trim transition region 304 and the third ankle collar trim transition region 306. Additionally, the ankle collar trim transition 300 provides enhanced reinforcing properties at the second ankle collar trim transition region 304 and the third ankle collar trim transition region 306 relative to the first ankle collar trim transition region 302. Accordingly, the ankle collar trim transition 300 facilitates a transition from the relatively more rigid materials of the upper 200 to a relatively less rigid material (for example inner material 504, as depicted and described with reference to FIG. 5) proximate the heel region top edge 216.

Figure 7:
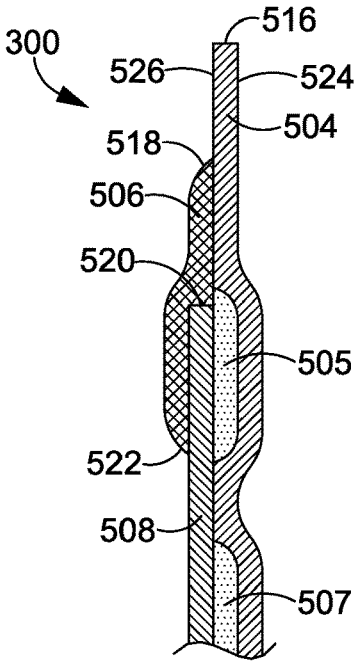
FIG. 7 depicts a close-up cross-sectional view of the ankle collar trim transition according to FIG. 5, in accordance with aspects hereof.

FIG. 7 depicts a close-up cross-sectional view of the ankle collar trim transition 300 according to FIG. 5, in accordance with aspects hereof. In aspects herein, the inner material 504 extends beyond the other materials at the ankle collar such that the first ankle collar trim transition region 302 is substantially formed from the inner material 504. Consequently, a thickness of the ankle collar is greater at a bottom portion than at an upper portion. Additionally, the inner material 504 may be made from a material that is more flexible than the material used to make the ankle collar reinforcing material 506 and/or the upper first material 508. This may provide for enhanced durability at the bottom portion of the ankle collar trim transition 300 while providing enhanced comfort and flexibility at the upper portion. For example, in some aspects, a top edge 516 of the inner material 504 is superior to a top edge 518 of the ankle collar reinforcing material 506 and a top edge 520 of the upper first material 508. Further, in some aspects, the top edge 518 of the ankle collar reinforcing material 506 is superior to the top edge 520 of the upper first material 508. Additionally, the inner material 504 may have an inner surface 524 that faces inward (toward the interior surface 500 of the heel region 214, as depicted above in FIG. 5) and an opposite outer surface 526 that faces outward (toward the exterior surface 502 of the heel region 214 as depicted above in FIG. 5). Accordingly, when the article of footwear 100 is in an as-worn configuration, a junction of the top edge 516 of the inner material 504 and the inner surface 524 of the inner material 504 is adjacent to the wearer.

Figure 8:
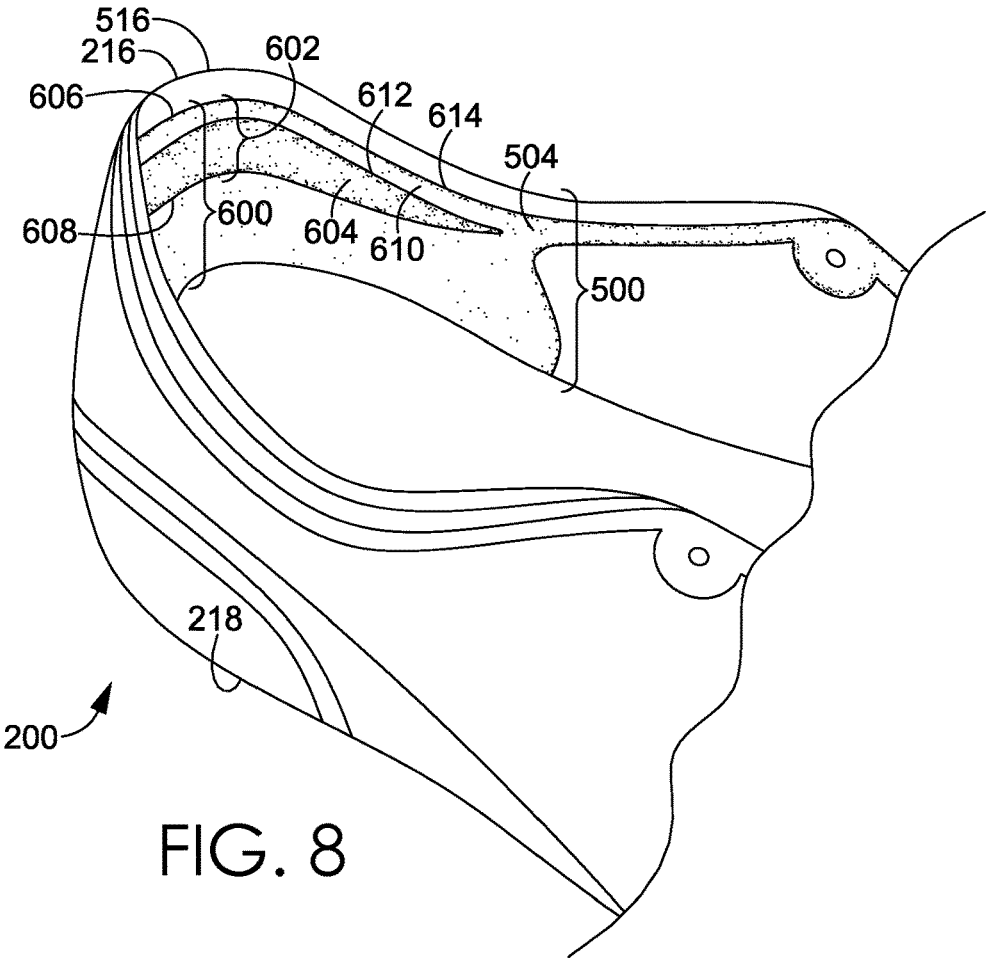
FIG. 8 depicts a partial top-down perspective view of the heel region of the upper, in accordance with aspects hereof.

FIG. 8 depicts a partial top-down perspective view of the heel region 214 of the upper 200, in accordance with aspects hereof. The heel region 214 may include a heel padding structure 600 at the interior surface 500. In some aspects, the heel padding structure 600 includes a first heel padding region 602. As such, in some aspects, the first heel padding region 602 comprises a first heel pad 604 disposed between the upper first material 508 (depicted, for example, in FIGS. 5 and 7 as 508) and the inner material 504, such that the first heel padding region 602 is covered by the inner material 504. In some aspects, the first heel pad 604 comprises the first heel padding material (depicted in FIGS. 5 and 7 as 507). In aspects herein, a top edge of the inner material 516 is superior to a top edge of the first heel padding region 606 and a bottom edge of the first heel padding region 608. Further, the bottom edge of the first heel padding region 608 may be superior to the heel region bottom edge 218, such that the first heel padding region 602 is disposed between the heel region top edge 216 and the heel region bottom edge 218. In additional aspects, the first heel padding region 602 further comprises a second heel pad 610 disposed superior to a top edge of the first heel pad 612. In some aspects, the second heel pad 610 comprises the second heel padding material (depicted in FIGS. 5 and 7 as 505). Additionally, the top edge of the inner material 516 may be superior to a top edge of the second heel pad 614, such that the second heel pad 610 is disposed between the top edge of the first heel pad 612 and the top edge of the first heel padding region 606.

Figure 9:
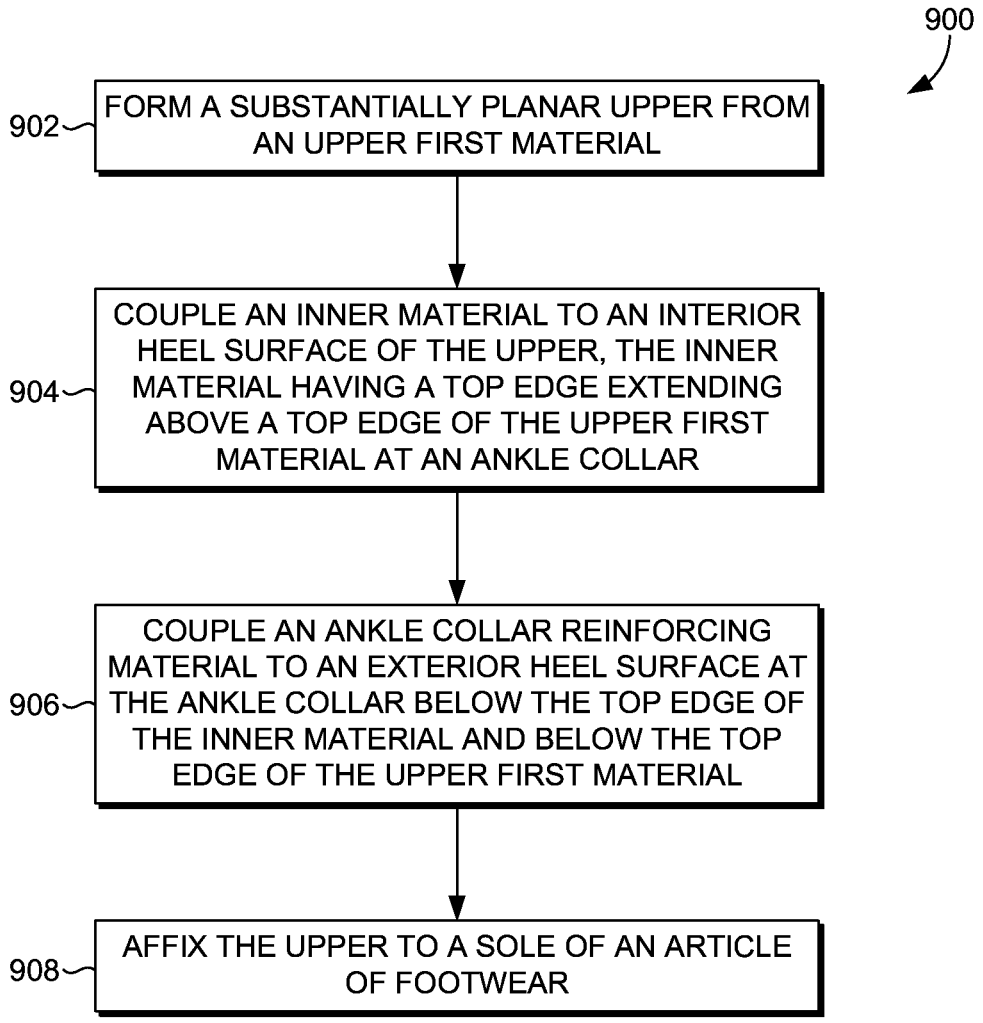
FIG. 9 illustrates a block diagram illustrating a method for manufacturing an article of footwear having an ankle collar trim transition, in accordance with aspects hereof.

FIG. 9 illustrates a block diagram illustrating a method for manufacturing an article of footwear having an ankle collar trim transition 900, in accordance with aspects hereof. At block 902, the method includes forming a substantially planar upper from an upper first material. At block 904, an inner material is coupled to a portion of the upper corresponding to an interior heel surface of the article of footwear, the inner material having a top edge extending above a top edge of the upper first material at an ankle collar. At block 906, an ankle collar reinforcing material is coupled to an exterior heel surface of the article of footwear at the heel end, wherein the ankle collar reinforcing material is disposed below the top edge of the inner material and below the top edge of the upper first material. As shown at block 908, the method for manufacturing an article of footwear may additionally include coupling or affixing the article of footwear to a sole. As used herein, "coupling" may refer to bonding, stitching, welding, adhering, or any other method of attaching one material or surface to another material or surface.

The method for manufacturing the article of footwear may further comprise coupling a first heel stay reinforcing material to an exterior surface of the upper first material. In additional aspects, the method for manufacturing the article of footwear additionally includes coupling a third heel stay reinforcing material to an exterior surface of the first heel stay reinforcing material. Further, the method may include coupling a second heel stay reinforcing material to an exterior surface of the third heel stay reinforcing material and the exterior surface of the first heel stay reinforcing material. In some aspects, a top edge of the first heel stay reinforcing material is superior to a top edge of the second heel stay reinforcing material, and the top edge of the second heel stay reinforcing material is superior to a top edge of the third heel stay reinforcing material.

The method for manufacturing the article of footwear may further comprise coupling a first heel pad to the upper first material at an interior surface of the upper first material at the heel region of the article of footwear. The method for manufacturing the article of footwear may further comprise coupling the inner material to the upper first material and the first heel pad such that the inner material comprises the interior heel surface of the article of footwear. In some aspects, the inner material top edge extends above a top edge of the upper first material and a top edge of the first heel pad. In additional aspects, the method for manufacturing the article of footwear further comprises coupling a second heel pad to the upper first material at the interior surface of the upper first material at the heel region of the article of footwear. Further, the second heel pad may be coupled to the upper first material at a portion of the upper first material that is superior to the first heel pad. The method for manufacturing the article of footwear may further comprise coupling the inner material to the upper first material, the first heel pad, and the second heel pad such that the inner material comprises the interior heel surface of the article of footwear. Additionally, the inner material top edge extends above the top edge of the upper first material, the top edge of the first heel pad, and a top edge of the second heel pad.

From the foregoing, it will be seen that aspects herein are well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible aspects may be made without departing from the scope thereof, it is to be understood that all matter herein set forth or shown in the accompanying drawings is to be interpreted as illustrative and not in a limiting sense.

What is claimed is:

1. An upper of an article of footwear having an exterior surface and an interior surface, the upper comprising:

a heel region having a heel region top edge;

an upper first material forming an anlde collar proximate the heel region top edge, the upper first material comprising at least a portion of an exterior surface of the upper; and an inner material having greater flexibility than the upper first material, the inner material having an interior surface and an opposing outer surface, wherein at least a portion of the inner material extends from proximate a strobel to the heel region top edge, and wherein the inner material extends up from the anlde collar such that the opposing outer surface of the inner material forms at least a portion of the exterior surface of the article of footwear superior to the upper first material and the interior surface of the inner material forms at least a portion of the interior surface of the article of footwear superior to the upper first material.

2. The upper of the article of footwear of claim 1, further comprising an anlde collar reinforcing material that overlaps a top edge of the upper first material and retains the top edge of the upper first material.

3. The upper of the article of footwear of claim 2, wherein the ankle collar reinforcing material extends around a heel end of the upper from a medial side of the upper to a lateral side of the upper.

4. The upper of the article of footwear of claim 2, wherein the ankle collar reinforcing material is less malleable than the inner material.

5. The upper of the article of footwear of claim 2, wherein the ankle collar reinforcing material comprises a thermoplastic material.

6. The upper of the article of footwear of claim 5, wherein the ankle collar reinforcing material is thermally bonded to each of the upper first material and the inner material.

7. The upper of the article of footwear of claim 2, wherein a top edge of the anlde collar reinforcing material is superior to the top edge of the upper first material at the anlde collar.

8. The upper of the article of footwear of claim 7, further comprising:

a first anlde collar trim transition region comprising the inner material, and not comprising the upper first material nor the anlde collar reinforcing material;

a second ankle collar trim transition region comprising the inner material and the ankle collar reinforcing material, and not comprising the upper first material; and a third ankle collar trim transition region comprising the inner material, the ankle collar reinforcing material, and the upper first material.

9. An article of footwear having an exterior surface and an interior surface, comprising:

a sole; and an upper, the upper comprising:

a toe end;

a heel end;

a medial side;

a lateral side; and a heel region extending between the medial side and the lateral side at the heel end, the heel region comprising:

a heel region top edge;

an ankle collar proximate the heel region top edge;

an upper first material comprising at least a portion of an exterior of the upper and extending from proximate the sole to the ankle collar; and an inner material extending from proximate the sole to the heel region top edge and up from the ankle collar, wherein the inner material comprises: an outer surface forming a portion of the exterior surface of the article of footwear superior to the upper first material, an inner surface opposing the outer surface and forming at least a portion of the interior surface of the article of footwear superior to the upper first material.

10. The article of footwear of claim 9, further comprising an ankle collar reinforcing material that overlaps a top edge of the upper first material and retains the top edge of the upper first material.

11. The article of footwear of claim 10, wherein the ankle collar reinforcing material comprises an elongate thermoplastic band that extends around the heel end of the upper from the medial side of the upper to the lateral side of the upper.

12. The article of footwear of claim 11, wherein the ankle collar reinforcing material is thermally bonded to each of the upper first material and the inner material.

13. The article of footwear of claim 10, wherein the ankle collar reinforcing material is less malleable than the inner material.

14. The article of footwear of claim 9, further comprising a heel stay reinforcing structure positioned at the heel region exterior surface.

15. The article of footwear of claim 9, further comprising a heel stay reinforcing structure inferior to the top edge of the heel region.

16. The article of footwear of claim 9, further comprising a heel padding region disposed in the heel region between the inner material and the upper first material, and between a heel region top edge and a heel region bottom edge.

17. The article of footwear of claim 9, wherein the inner material is a single layer.

* * * * *